United States Patent [19]

Andou

[11] Patent Number: 4,913,366

[45] Date of Patent: Apr. 3, 1990

[54] WEB UNWINDER WITH CORE DIAMETER MEASURING DEVICE

[75] Inventor: Hiromu Andou, Shizuoka, Japan

[73] Assignee: Fuji Photo Film Co., Ltd., Kanagawa, Japan

[21] Appl. No.: 267,225

[22] Filed: Nov. 2, 1988

[30] Foreign Application Priority Data

Nov. 2, 1987 [JP] Japan ..... 62-168280[U]

[51] Int. Cl.[4] ..... B41J 29/48; B65H 26/08

[52] U.S. Cl. ..... 242/57; 250/561; 250/571

[58] Field of Search ..... 242/57, 67.5, 75.45; 250/561, 571; 33/655, 657

[56] References Cited

U.S. PATENT DOCUMENTS 3,971,956 7/1976 Jakeman et al. ..... 250/571
4,276,910 7/1981 Eichenberger ..... 250/571 X
4,657,198 4/1987 Shimizu et al. ..... 242/57

FOREIGN PATENT DOCUMENTS 202246 11/1983 Japan .
207244 12/1983 Japan .

*Primary Examiner*—Stuart S. Levy
*Assistant Examiner*—Steven M. duBois
*Attorney, Agent, or Firm*—Young & Thompson

[57] ABSTRACT

A web unwinder is provided with an arm movable in a direction parallel to the axis of a web roll according to the width of the web. Two position detectors are mounted on the arm; one is for detecting a position of one of the ends of the web roll, and the other is for measuring a diameter of a core of the web roll.

7 Claims, 2 Drawing Sheets

WEB UNWINDER WITH CORE DIAMETER MEASURING DEVICE

BACKGROUND OF THE INVENTION

The present invention relates to a web unwinder and more particularly to an improved web unwinder in which a position detecting means for measuring the diameter of a core does not interfere with the web roll assembly.

A web unwinder is used for feeding a web such as photographic film, paper, cloth, or the like drawn out from a web roll to a working line. In the web unwinder, a web roll assembly comprising a core and a web roll around the core is rotatably mounted. While the web is continuously drawn out, the amount of the web in the web roll is measured. When the amount of the web decreases to a predetermined first limit value, the web feeding speed is caused to decrease. Then, the feeding of the web is caused to stop when the amount of the remaining web decreases to a predetermined second limit value. After the stoppage of the web feeding, the web roll assembly is replaced with a new web roll assembly wound with a full web.

The amount of the remaining web in the web roll can be calculated from the winding thickness of the web roll. For this calculation, the diameters D and d of the web roll and the core, respectively, are measured. If the diameters d of all of the core were exactly the same, only the diameters D of the web roll would be measured. Actually, there is a variation in the values of the core diameter d even though the cores are of the same type. Therefore, the diameter d of each core must be precisely measured, especially when the web is very thin.

As is shown in FIG. 2, a web roll assembly 2 of the prior art comprises a core 4 and web roll 3 wound with a web 5 around the core 4. The measurement of the core diameter d is performed by using an optical position detector 6 facing the surface of the core 4. The measurement of the web roll diameter D is also performed by using another optical position detector (not shown in FIG. 2) facing one of the ends of the web roll 3. The optional position detector 6 comprises a light source such as a laser diode, and a line sensor 9. A light beam emitted from the light source is projected onto a surface of the core 4 through a lens 8*a*. Part of the light reflected from the surface of the core 4 is received by a line sensor 9 through a lens 8*b*. According to the position wherein the incident light is received by the line sensor 9, the line sensor 9 generates a position signal corresponding to the radius of the core 4. Based on the position signal, the core diameter d can be calculated as follows: previously a diameter $d_1$ of a reference core is measured, for example, with a caliper. Next, the reference core and another core having an unknown diameter are measured with the optical position detector 6. When the position signal of the reference core corresponds to the radius $r_1$ and the position signal of the core corresponds to the radius $r_2$, the unknown diameter $d_2$ of the core is given by $$d_2 = d_1 + 2(r_1 - r_2)$$

The above measurement is described in detail in U.S. Pat. No. 4,657,198.

In a measurement with such an optical position detector 6, the detector 6 is disposed as close as possible to the core 4. The reason for this is that it is desirable that the intensity of the light projected onto the surface of the web be greater, and the intensity of the incident light falling on the line sensor 9 is also greater. Furthermore, it is also a requirement that the optical axis 7*a* of the light beam be preferably perpendicular to the web surface as shown in FIG. 3. Accordingly the optical position detector 6 is required not to interfere with the web roll 3 even when the web roll has a large width of web 5 and a larger diameter of web roll.

In view of these circumstances, there has been proposed a core diameter measuring device which is disclosed in Japanese Utility Model Application No. 62-33969. The core diameter measuring device has a position detector which is slanted to the vertical line of the surface of the core 4 so as to be away from the side of the web roll 3. In this core diameter measuring device, there is still an unsolved problem in that the position detector interferes with the web roll which may have an undesirably great width of web. In order to solve this problem, another arrangement of the position detector 6 can be considered. That is, the position detector is mounted for movement with a moving member movable according to the width of the web. This method, however, leads to a larger and more complicated web unwinder. If the web roll assembly is set inaccurately, the position detector would interfere with the web roll and a position to be measured on the core would undesirably change.

OBJECTS OF THE INVENTION

It is therefore the main object of the present invention to provide a web unwinder in which a web roll never interferes with a position detector for measuring the diameter of a core even when the web rolls have various widths.

It is another object of the present invention to provide a web unwinder in which interference of a web roll with a position detector for measuring the diameter of a core can be avoided by utilizing an existing mechanism in the web unwinder without making the web unwinder more complicated.

SUMMARY OF THE INVENTION

In order to achieve the above and other objects and advantages, according to the present invention, a movable arm provided with a first position detector is used as a shifting mechanism for a second position detector. The first position detector is for detecting one of the ends of a web roll and the second position detector is for detecting the surface of a core.

Accordingly, interference of the web roll with the second position detector can be avoided without fail. The movable arm needs no shifting mechanism exclusively used for moving the second position detector, thereby avoiding complication of the structure of the web unwinder and an increase in the cost of the web unwinder.

BRIEF DESCRIPTION OF THE DRAWINGS

These and other objects and features of the invention will be seen by reference to the following description, taken in connection with the accompanying drawings in which.

DETAILED DESCRIPTION OF THE INVENTION

Figure 1:
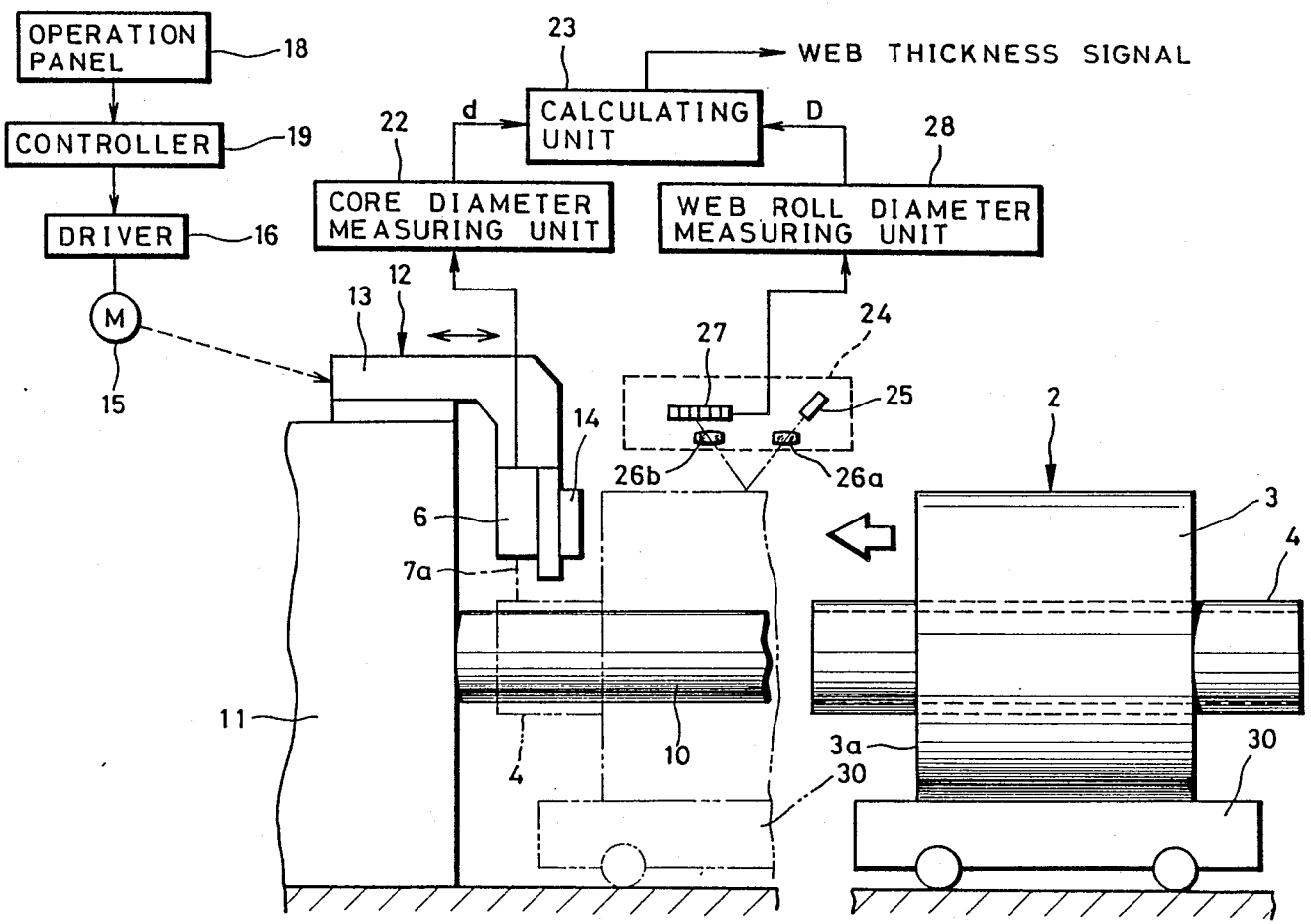
FIG. 1 is a side view showing a schematic illustration of a web unwinder of the present invention.
Figure 2:
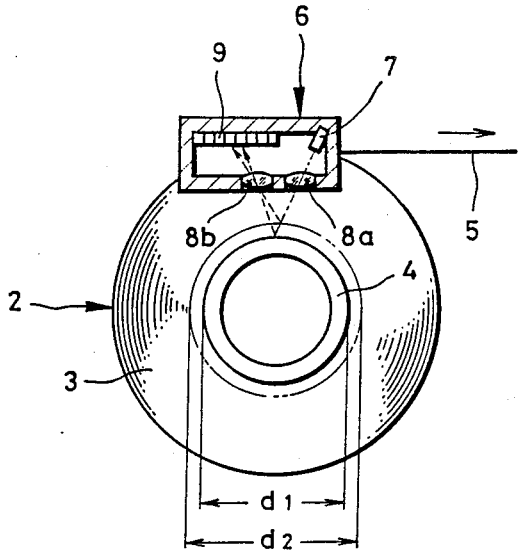
FIG. 2 (PRIOR ART)
FIG. 2 is a side view showing a conventional position detector for a core.
Figure 3:
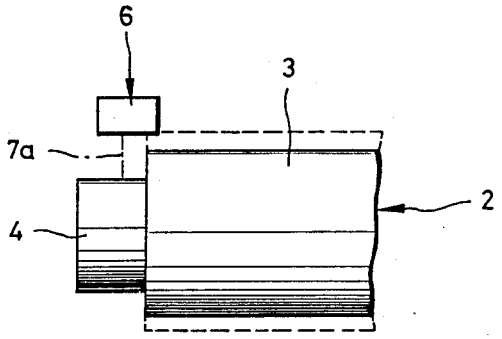
FIG. 3 (PRIOR ART)
FIG. 3 is a front view of the position detector for a core, shown in FIG. 2.

In the drawings the same numerals and characters designate the same parts or members. FIG. 1 shows a preferred embodiment of the present invention. As is well known to those skilled in the art, a web unwinder usually has a fixed section 11 rotatably fitted with an unwinding shaft 10 and a movable section (not shown, but disposed to the right of FIG. 1) movable toward and away from the fixed section 11. The fixed section 11 is provided therein with an electric motor (not shown) for rotating the shaft 10 at a speed corresponding to a processing speed of a working line. When mounting the web roll assembly 2 on the web unwinder, the movable section is initially positioned away from the fixed section 11 to provide clearance to mount the core 4 on the shaft 10. After mounting, the movable section is moved toward the fixed section to a holding position in which the movable section rotatably supports the free end of the shaft 10.

Because the web rolls differ in web width, it is necessary at all times to align the center line of the web 5 drawn out from the web roll 3 with the center line of the web transporting path. For setting the position of the web roll 3 on the shaft 10 according to the web width, a size change unit 12 is provided. The size change unit 12 comprises a movable arm 13 movable in the axial direction of the shaft 10, a web roll end position detector 14 fitted to the side of the free end of the movable arm 13, an electric motor 15 for sliding the movable arm 13, and a driver 16 for driving the electric motor 15. The movable arm 13 is slidably fitted on the top of the fixed section 11 of the web unwinder and adjusted to a predetermined position corresponding to the web width. The web roll end position detector 14 comprises a projector and a line sensor and optically detects an end 3*a* of the web roll 3 when mounting the web roll assembly 2. Data of web width are input through a control panel 18 and stored in a controller 19, which controls the electric motor 15 as to the direction and amount of its rotation. The control panel 18 is available to input other data and instructions than the data of the web width. The controller 19 also controls other sections and parts of the web unwinder.

A well-known chucking mechanism (not shown) is attached to the rewind shaft 10 in order to ensure that the web roll assembly 2 does not deviate from its proper position on the shaft 10 while the web 5 is unwound. The chucking mechanism clamps securely the core 4 when the web roll end detector 14 detects that the end 3*a* of the web roll 3 has moved to its predetermined position.

On the underside of the movable arm 13, there is provided a core position detector 6 for detecting a position of a surface of the core 4 to output a position signal corresponding to the radius of the core 4. The position signal is sent to a core diameter calculating unit 22 for calculating the core diameter d as described before. The core diameter calculating unit 22 generates a signal representing the core diameter d and this signal is sent to a calculating unit 23 for calculating the amount of the remaining web 5 in the web roll 3.

A web roll surface position detector 24 like the other position detectors 6 and 14 comprises a light source 25, lenses 26*a* and 26*b*, and a line sensor 27 so as to detect a position of the peripheral surface of the web roll and to generate a position signal. This signal is sent to a web roll diameter calculating unit 28 for calculating a web roll diameter D. A signal representing the web roll diameter D is generated in the web roll diameter calculating unit 28 and is sent to the calculating unit 23, which calculates a thickness of the rest of the web 5 based on the core and web roll diameters d and D. From this thickness, the length of the rest of the web 5 can be obtained by calculation. An apparatus for measuring the web length is made up of the above parts and members.

Numerals 30 designates a transporter for transporting a new web roll assembly 2 in order to mount the new web roll assembly 2 on the web unwinder.

Next, the function of the above-described embodiment will be set forth. Before a new web roll 3 is mounted in the web unwinder, data of the width of the new web roll 3 is input through the control panel 18. According to the data, the controller 19 generates signals for driving the electric motor 15 through the driver 16. The electric motor rotates to shift the movable arm 13 to a proper position corresponding to the web width in the axial direction of the rewind shaft 10. In this way, the web roll end position detector 14 is set at a predetermined position. Simultaneously, the core position detector 6 is precisely placed at a position suitable for this detection. Because the core position detector 6 is provided at a position closely adjacent to the web roll end position detector 14, there are the advantages that interference of the core position detector 6 with the web roll 3 can be avoided, and the core position detector 6 will reliably project a light beam onto a suitable measurement area of the core surface. Furthermore, position adjusting means exclusively used for the core position detector 6 can be omitted, thereby simplifying the structure of the web unwinder.

As shown by solid lines in FIG. 1, the transporter 30 loaded with a new web roll assembly 2 moves toward the web unwinder with the core 4 coaxially aligned with the shaft 10. Upon further movement of the transporter 30 in the axial direction of the shaft 10, the shaft 10 enters the hollow core 4. Since the web roll end position detector 14 detects the position of the web roll end, the transporter stops at a position as shown by broken lines when the detected distance between the detector 14 and the web roll end becomes a predetermined values. At the same time, the chucking mechanism clamps the core 4 to the shaft 10. By this clamping, the center line of the web roll 3 can be accurately maintained on the center line of the web transporting path of the web unwinder.

After the mounting of the new web roll assembly 12, the movable section, described before, of the web unwinder returns to its operational position to hold the free end of the shaft 10 rotatably. Then, the platform of the transporter 30 is lowered in order that the transporter 30 can leave the web unwinder. Lastly, the leading end of the web 5 is drawn out from the web roll 3 to be sent to a pair of feeding rollers (not shown). While the web 5 is unwound from the web roll 3, the shaft 10 and the pair of feeding rollers rotate to feed the web 5 to the working line.

The procedure for measuring the length of the web 5 in the web roll 3 will now be explained. The core position detector 6 detects the position of the core surface by projecting a light beam onto the core surface and receiving part of the light reflected from that surface. Based on the position at which the reflected light is received in the line sensor of the detector 6, the detector 6 generates a signal representing this position. This signal is sent to the core diameter calculating unit 22, which calculates the core diameter d to send a signal representing the core diameter d to the calculating unit 23. In the meantime, the web roll surface position detector 24 detects the position of the peripheral surface of the web roll 3 in a way similar to the detection of the core position. A position signal generated in the web roll surface position detector 24 is sent to the web roll diameter measuring unit 28, which outputs a signal representing the web roll diameter D to the calculating unit 23. The calculating unit 23 calculates the thickness of the web roll from the core diameter d and the web roll diameter D. This calculated thickness corresponds to the length of the rest of the web 5 in the web roll 3. A signal representing this thickness is generated in the calculating unit 23 and is used for, for example, control of exchanging the web roll assembly and furthermore may be used as a timing signal for other process controls.

Although the core position detector 6 is provided on the underside of the movable arm 13 in the above-described embodiment, it is not limited to this position. That is, the core position detector 6 may be fitted on the movable arm at any position which is farther away from the web roll end than is the web roll end position detector 14 and in which position the core position detector 6 can project a light beam onto the surface of the core 4 and receive the reflected light. The core position detector 6 and the web roll end position detector 14 may comprise integrally a single unit.

Although a preferred embodiment has been described, it is to be understood that modifications and variations may be made without departing from the scope of the present invention.

What is claimed is:

1. A web unwinder for rotatably holding a core of a web roll during unwinding of a web from a web roll on the core, comprising:

first detecting means for detecting a position of one end of the web roll in order to determine the position of the web roll;

an arm carrying in said first detecting means;

means mounting said arm for movement in a direction parallel to the rotary axis of the core; and second detecting means for detecting a position of the surface of the core, said second detecting means being mounted on said arm.

2. A web unwinder as claimed in claim 1, wherein said second detecting means comprises a projector projecting a light beam onto the surface of the core, and a line sensor receiving part of the light beam reflected from the surface of the core and generating a first signal representing the position of the surface of the core.

3. A web unwinder as claimed in claim 1, wherein said first detecting means is provided on a side of said arm, and said second detecting means is provided on the underside of said arm.

4. A web unwinder as claimed in claim 1, further comprising means for inputting data of the width of the web, and an electric motor for moving said arm by an amount determined by said input data.

5. A web unwinder as claimed in claim 2, further comprising first calculating means for calculating a diameter of the core based on the first signal.

6. A web unwinder as claimed in claim 5, further comprising third detecting means for detecting a position of the peripheral surface of the web roll and for generating a second signal representing the position of the peripheral surface of the web roll, and second calculating means for calculating a diameter of the web roll based on the second signal.

7. A web unwinder as claimed in claim 6, further comprising third calculating means for calculating the thickness of the wound web roll based on the diameters of the web roll and the core.

* * * * *